US007224275B2

(12) United States Patent
Fitzgibbon

(10) Patent No.: US 7,224,275 B2
(45) Date of Patent: May 29, 2007

(54) MOVABLE BARRIER OPERATORS STATUS CONDITION TRANSCEPTION APPARATUS AND METHOD

(75) Inventor: James J. Fitzgibbon, Batavia, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 162 days.

(21) Appl. No.: 10/447,663

(22) Filed: May 29, 2003

(65) Prior Publication Data

US 2004/0239496 A1 Dec. 2, 2004

(51) Int. Cl.
*G08B 1/08* (2006.01)
*G08C 19/00* (2006.01)
*E05F 15/20* (2006.01)

(52) U.S. Cl. ..... 340/539.26; 340/545.1; 340/539.1; 340/825.69; 340/825.72; 340/686.1; 49/25; 49/31

(58) Field of Classification Search ..... 340/825.69, 340/825.72, 539.26; 49/25, 31
See application file for complete search history.

(56) References Cited

U.S. PATENT DOCUMENTS 3,611,333 A 10/1971 Conigliaro
3,827,038 A 7/1974 Willis
3,831,158 A 8/1974 Rempel et al.
3,833,895 A * 9/1974 Fecteau ..... 340/505
4,074,269 A 2/1978 Hartley
4,090,182 A 5/1978 Young
4,124,847 A 11/1978 Cashman
4,464,651 A * 8/1984 Duhame ..... 340/521
4,536,751 A 8/1985 Shigemitsu et al.
4,583,081 A 4/1986 Schmitz
4,750,118 A 6/1988 Heitschel et al.
4,819,379 A 4/1989 Kenzelmann et al.
4,868,543 A 9/1989 Binkley
4,872,210 A 10/1989 Benages
4,905,279 A 2/1990 Nishio
4,954,810 A 9/1990 Llewellyn
5,402,105 A * 3/1995 Doyle et al. ..... 340/539.22
5,635,913 A 6/1997 Willmott et al.
5,798,681 A * 8/1998 Chang ..... 336/83
5,903,226 A * 5/1999 Suman et al. ..... 340/825.69
6,025,785 A 2/2000 Farris et al.
6,049,289 A 4/2000 Waggamon et al.
6,070,361 A 6/2000 Paterno
6,184,787 B1 * 2/2001 Morris ..... 340/521
6,218,956 B1 * 4/2001 Davis et al. ..... 340/5.2
6,346,889 B1 2/2002 Moss
6,597,291 B2 * 7/2003 Tsui ..... 340/686.1
2002/0180600 A1 * 12/2002 Kirkland et al. ..... 340/545.1
2003/0029579 A1 2/2003 Mays
2003/0076235 A1 4/2003 Tsui
2004/0212498 A1 * 10/2004 Peterson et al. ..... 340/539.25

OTHER PUBLICATIONS

U.S. Appl. No. 10/226,854, filed Aug. 23, 2002, Doyle.
British Search Report for British patent application GB0412067.1 dated Oct. 4, 2004.

* cited by examiner

*Primary Examiner*—Donnie L. Crosland
(74) *Attorney, Agent, or Firm*—Fitch, Even, Tabin & Flannery

(57) ABSTRACT

A movable barrier operator (10) has a wireless status condition data transmitter (15) that wirelessly transmits status condition messages to one or more remote peripherals (20). The latter can in turn use this status information to effect their own functionality and supported features.

31 Claims, 2 Drawing Sheets

MOVABLE BARRIER OPERATORS STATUS CONDITION TRANSCEPTION APPARATUS AND METHOD

TECHNICAL FIELD

This invention relates generally to movable barrier operators.

BACKGROUND

Movable barriers of various kinds are known in the art, including but not limited to horizontally and vertically sliding barriers, vertically and horizontally pivoting barriers, single-piece barriers, multi-piece or segmented barriers, partial barriers, complete barriers, rolling shutters, and various combinations and permutations of the above. Such barriers are typically used to control physical and/or visual access to or via an entryway (or exit) such as, for example, a doorway to a building or an entry point for a garage.

In many cases, a motor or other motion-imparting mechanism is utilized to effect selective movement of such a movable barrier. A movable barrier operator will then usually be utilized to permit control of the motion-imparting mechanism. In some cases a user may control the movable barrier operator by indicating a selection via one or more control surfaces that are physically associated with the movable barrier operator. In other cases such control can be effected by the transmission of a wireless remote control signal to the movable barrier operator.

Over time, the capabilities of and features supported by such movable barrier operators has expanded to include actions other than merely opening and closing a corresponding movable barrier. Some movable barrier operators provide ambient lighting. Some movable barrier operators can sense the likely presence of an obstacle in the path of the movable barrier and take an appropriate corresponding action. And some movable barriers have a plurality of operating modes to facilitate differing control strategies (for example, many movable barrier operators have a so-called vacation mode that prompts use of a differing set of operational states when the user leaves the movable barrier operator for an extended period of time or a learning mode that places the movable barrier operator into a programmable state to permit manual and/or automatic setting or selection of one or more operational parameters such as a maximum force setting).

Installation settings and needs can vary considerably from one place to another. Notwithstanding this truism, movable barrier operator manufacturers prefer to seek the economies of scale that attend the manufacture and distribution of movable barrier operator platforms that will provide satisfactory service in a wide variety of settings. As a result, some movable barrier operators are manufactured with the ability to support a wide range of functionality. Unfortunately, this often means that a physical interface must be provided to support numerous potentially utilized peripheral devices (including but not limited to sensors, control surfaces, alarms, displays, ambient and/or spot lighting, and so forth). This physical interface can represent undesired additional cost when part of the interface goes unused in a given installation.

Furthermore, even when a given installation includes use of all potentially supported peripherals, the physical installation itself will often necessarily include a physical signaling path to couple the movable barrier operator to the various peripherals. This in turn can result in undesired exposed wiring and/or an undesired increase of installation time.

It is also likely in some installation settings that the physical interface of a given movable barrier operator, regardless of how well conceived in the first instance, may nevertheless fail to permit compatible support of a given peripheral. For example, a given user may wish to provide a quantity of individual lighting platforms that exceeds the number of lights that are supported by the physical interface for a given movable barrier operator. As another example, another given user may wish to support a relatively new function, such as an alarm that sounds when a possibly unauthorized individual enters an opened entryway, that is not specifically supported by a given movable barrier operator.

For these and other reasons, prior art movable barrier operators are often partially or wholly inadequate to suit the present and/or developing needs of a given application.

BRIEF DESCRIPTION OF THE DRAWINGS

The above needs are at least partially met through provision of the movable barrier operator status condition transmission apparatus and method described in the following detailed description, particularly when studied in conjunction with the drawings, wherein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION

Generally speaking, pursuant to these various embodiments, a movable barrier operator has a controller having a plurality of potential operational status conditions, a movable barrier interface that operably couples to the controller, and a wireless status condition data transmitter that is operably coupled to the controller as well. If desired, one or more status condition sensors can be utilized to sense one or more predetermined conditions and to provide corresponding indicia to the controller. In a preferred embodiment, the wireless status condition data transmitter transmits a status condition signal that corresponds to at least one of the potential operational status conditions. If desired, the status condition signal can be combined with an identifier that correlates (uniquely or relatively uniquely) to the controller and/or the movable barrier operator. Such an identifier can serve to permit a receiving device to process as appropriate the status condition information.

Such status condition information can be received and processed, in a preferred embodiment, by a remote peripheral device (such as, but not limited to, a display, an alarm, a lighting control unit, and so forth). If desired, although the status condition information does not comprise a control signal as such (meaning that the status condition information does not comprise an instructional signal but rather presents only informational content), the remote peripheral can be configured to process the data content to thereby nevertheless effect a desired corresponding action.

So configured, a given movable barrier operator can be set to wirelessly transmit a wide variety of simple messages regarding its operational states. Such information can then be utilized to compatibly support a wide range of presently desired and later-developed features and functionality. If desired, the overall cost of a given platform can be reduced as the need to over-design a physical peripheral interface becomes diminished. Furthermore, such a platform has an improved opportunity to remain compatible with evolving features and legal and/or regulatory requirements to thereby promote a longer useful service life.

Figure 1:
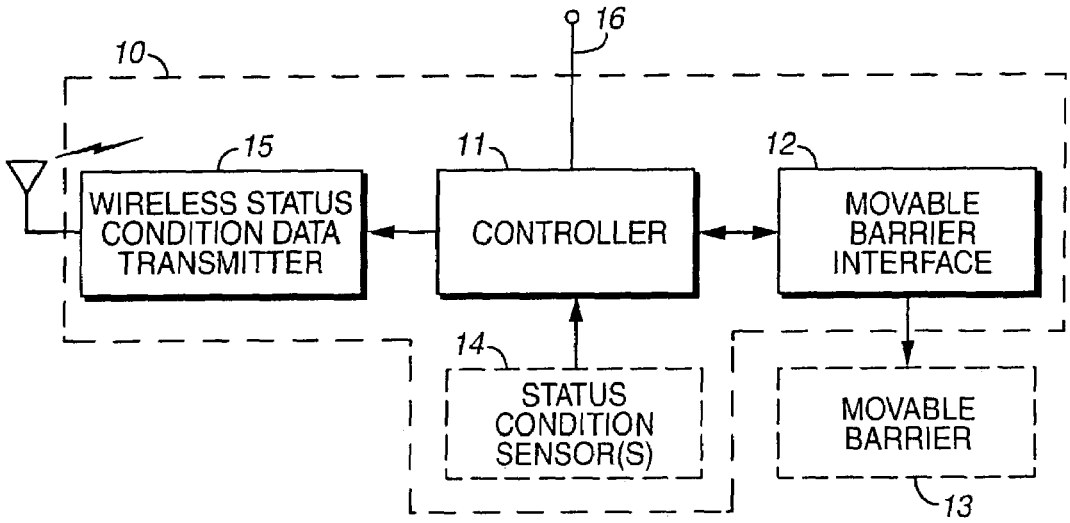
FIG. 1 comprises a block diagram as configured in accordance with various embodiments of the invention.

Referring now to the drawings, and in particular to FIG. 1, in a preferred embodiment a movable barrier operator 10 will include a controller 11, a movable barrier interface 12, and a wireless status condition data transmitter 15. The controller 11 will preferably comprise a programmable platform (such as, for example, a microprocessor, a microcontroller, a programmable logic or gate array, or the like) that can be readily programmed and configured in accordance with the various teachings set forth herein and as is generally well understood in the art. The movable barrier interface 12 couples to and is controlled by the controller 11 and further couples to a movable barrier 13. Various mechanisms now known or hereafter developed can serve as the movable barrier interface 12 including various drive mechanisms, clutch arrangements, and so forth. In general, the movable barrier interface 12 serves to selectively impart motion to the movable barrier 13 to cause the movable barrier 13 to move to a desired position (such as, for example, a fully opened or a fully closed position) and/or to restrict or prohibit such motion (as when movement of the movable barrier may be the result of gravity and the movable barrier interface 12 serves in part to prevent such movement until such movement is desired). Such controllers 11 and movable barrier interfaces 12 are well understood in the art, and therefore, for the sake of brevity and the preservation of focus, additional explanatory detail regarding such mechanisms will not be provided here.

The wireless status condition data transmitter 15 operably couples to an output of the controller 11. This transmitter 15 can be of any variety as may suit the needs of a given application. For example, the transmitter 15 can comprise a radio frequency carrier-based transmitter, an infrared carrier-based transmitter, or a sonic carrier-based transmitter (all being generally well understood in the art). In a similar fashion, the transmission power, modulation type, signaling protocol, and other attendant characterizing features and practices of the wireless transmitter 15 can again be as desired to suit the needs of a particular setting. In a preferred embodiment, this transmitter 15 will comprise a relatively low power transmitter such that the signals it broadcasts are only receivable within a relatively constrained area (such as, for example, an effective range of 100 meters, 500 meters, 1,000 meters, or the like). Again, such transmitters are well understood in the art and hence further elaboration here will not be provided.

In a typical embodiment, the controller 11 will have a plurality of potential operational status conditions. For example, the controller 11 might have two or more of the following potential operational status conditions:

- moving the movable barrier in a first direction (such as towards a closed position);
- moving the movable barrier in a second direction (such as towards an opened position);
- reversing movement of the movable barrier (for example, to alter movement from a closed position and towards an open position);
- halting movement of the movable barrier;
- detecting a likely presence of an obstacle (such as a person or pet) in the likely path of movement of the movable barrier;
- detecting a likely proximal presence of a human (such as a person in the vicinity of the controller);
- detecting a likely proximal presence of a compatible transmitter (such as a corresponding remote control transmitter for the movable barrier operator);
- receiving a wireless remote control signal (as sourced, for example, by a handheld remote control device);
- receiving a wireline remote control signal (as sourced, for example, by a wall mounted remote control device);
- receiving a learning mode initiation signal (via, for example, a switch provided for this purpose on the movable barrier operator housing);
- a lighting status change (as when, for example, the controller switches ambient lighting in a garage to an off condition a predetermined period of time following closure of the movable barrier);
- a vacation mode status change (as when a user effects this change via a switch provided for this purpose);
- detecting a likely proximal presence of a vehicle;
- detecting the identification of a proximal vehicle (as when, for example, the vehicle or some corresponding agent device transmits an identifying signal); and
- receiving an operating parameter alteration signal (via, for example, an integral or remote switch or other user interface).

It will be understood and appreciated that these are intended for illustrative purposes only, and that a given controller may have only a subset of these status conditions, a combination of some or all of these status conditions with other status conditions, or a set of wholly different potential status conditions.

Depending upon the needs of the setting, the controller 11 can be self-aware of such operational status conditions (as when, for example, the controller 11 is aware that it has switched a given ambient light fixture on or off) or the controller 11 can be provided with externally developed information regarding the condition. To effect the latter, it may be desirable in some settings to use one or more status condition sensors 14. Such sensors 14 can be disposed integral to the movable barrier operator 10 as suggested by the illustration in FIG. 1 and/or can be configured as remotely disposed entities to suit the requirements of a specific application.

Pursuant to these various embodiments, the wireless status condition data transmitter 15 serves to transmit a status condition signal that represents a present operational status condition of the controller 11. In a preferred embodiment, this transmission occurs automatically in response to when the controller 11 detects at least one predetermined condition, which predetermined condition preferably, but not necessarily, corresponds to the present operational status being reported via the transmission. Another option would be to have such information transmitted on a substantially regular periodic basis. An illustrative (but not all-inclusive) listing of potentially useful predetermined conditions might include:

moving the movable barrier in a first direction;
moving the movable barrier in a second direction;
reversing movement of the movable barrier;
halting movement of the movable barrier;
detecting a likely presence of an obstacle to movement of the movable barrier;
detecting a likely proximal presence of a human;
receiving a wireless remote control signal;
receiving a wireline remote control signal;
receiving a learning mode initiation signal;
receiving an operating parameter alteration signal;
expiration of a predetermined duration of time; and
attainment of a predetermined point in time.

In a preferred approach, this status condition signal does not constitute a control signal per se. That is to say, the controller 11 does not necessarily source this status condition signal as a specific part of implementing a control strategy. As an example, the controller 11 would not source this status condition signal to specifically cause a light to be switched on upon receipt of the signal. Instead, the controller 11 sources this status condition signal to specify that it has, through some other means, initiated a control action or strategy to cause a light to be switched on. The status condition signal then simply reflects the actions being taken by the controller 11 and/or the other operational conditions being experienced by the controller 11.

If desired, such status condition data signals can also be transmitted by the controller 11 via a wireline connection 16.

Figure 2:
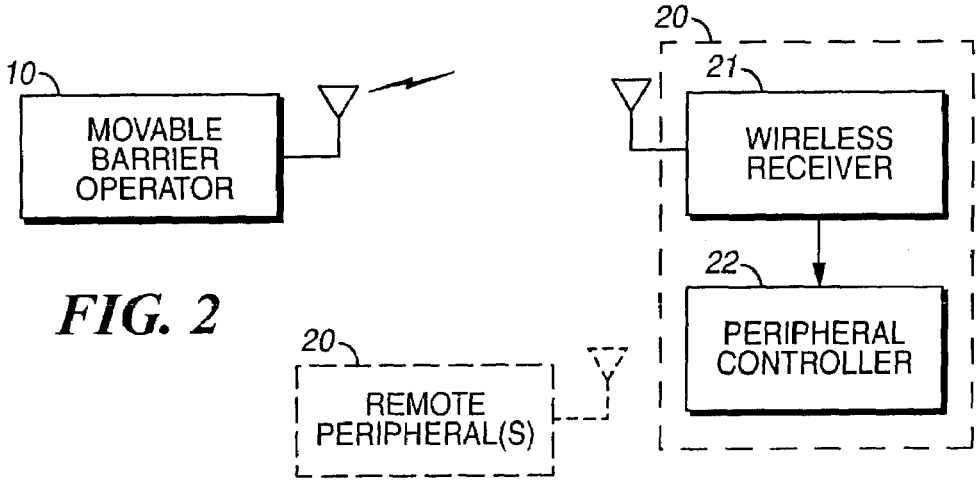
FIG. 2 comprises another block diagram as configured in accordance with various embodiments of the invention.

Referring now to FIG. 2, the status condition signals as transmitted from such a movable barrier operator 10 are preferably received by a remote peripheral 20 having a corresponding compatible wireless receiver 21 that operably couples to a peripheral controller 22. The remote peripheral 20 itself can comprise any of a wide variety of platforms, including but certainly not limited to an informational display, a remote access interface, a light fixture, a timer apparatus, an alarm unit, and so forth. So configured, the remote peripheral 20, upon receiving status condition information from the movable barrier operator 10 via the wireless transmissions being sourced by the latter, can process that information in accord with a desired end result. For example, the remote peripheral 20 can serve to simply further communicate such status information via a display such as an alphanumeric display, a graphic images display, one or more signal lights and/or corresponding indicative audible sounds, and so forth.

As another example, the remote peripheral 20 can process such status information to then itself ascertain a particular resultant course of activity. To illustrate, the remote peripheral can comprise a peripheral lighting unit that controls the provision of ambient lighting in a particular area (such as in a yard area outside the entrance to a residential garage). Upon receiving a status condition signal from the movable barrier operator 10 indicating that the movable barrier operator 10 has switched on its own lights, the remote peripheral 20 can then itself determine to also switch on its own lights. In a similar fashion, upon being informed that the movable barrier operator 10 has switched its lights off, the remote peripheral 20 can also decide to switch its own lights to an off condition.

So configured, it can be seen that when a movable barrier operator 11 provides wireless signals that represent one or more status conditions, a wide variety of known and hereafter developed remote peripherals 20 can be readily configured to leverage the receipt of such information for a variety of other purposes. Such remote peripherals can further supplement or extend the functionality of the movable barrier operator 10 itself (as when the remote peripheral 20 simply activates additional lighting to complement the lighting strategy of the movable barrier operator 10) or they can facilitate functionality that is above and beyond the control architecture of the movable barrier operator 10. To support the latter, it is preferred that the movable barrier operator 10 tend towards a relatively rich data stream where at least many or even substantially all current operational status conditions are regularly noted and transmitted to thereby provide considerable informational grist for use by the remote peripherals to thereby more likely facilitate additional not-otherwise-supported functionality.

Figure 3:
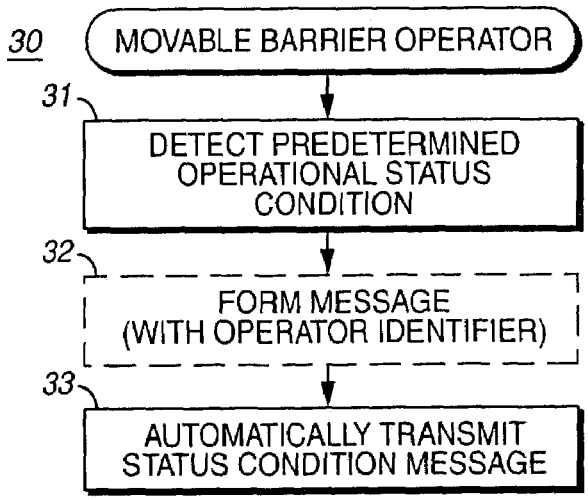
FIG. 3 comprises a flow diagram as configured in accordance with an embodiment of the invention.

Referring now to FIG. 3, the movable barrier operator 10 related above serves as an appropriate platform to effect a process 30 wherein one or more predetermined operational status conditions are detected 31. In a preferable approach, monitoring (and/or condition occurrence sensitivity) to support such detection occurs on a regular, or even substantially constant, basis. It is also preferred that a plurality of operational status conditions be monitored such that a plurality of differing operational status conditions can be so detected as they occur. As noted earlier, such monitoring and detection can result through one or more operational status condition sensors and/or through the ability of the controller to self-monitor its own operational status.

Figure 4:
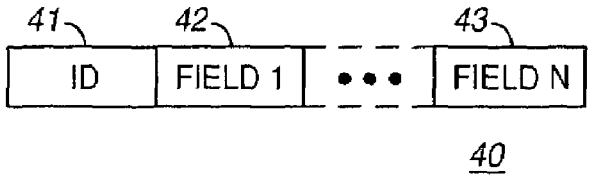
FIG. 4 comprises a schematic view of a message packet as configured in accordance with various embodiments of the invention.

Upon detecting such a condition, the process 30 then forms 32 a message that includes content to relate, reflect, or otherwise correspond to the detected status condition. In an optional approach, this message can be formed to include an identifier for the movable barrier operator. For example, and referring now momentarily to FIG. 4, such a message 40 can include a first field 41 that includes a specific identification number that is at least relatively unique to a given movable barrier operator and that also includes one or more additional data fields. A single data field can be used if desired to contain information that corresponds to the specified status condition. As another approach, and as illustrated, a plurality of fields (from field 1 41 to field N 43) can be provided, with each field corresponding to, for example, a particular monitored condition. The content of such fields could then comprise one or more flags or other indicia to indicate a particular present status for each such field. (In another approach, such indicia could also provide an indication as to an anticipated or planned change to the status of a given condition including, where available, an anticipated or planned temporal schedule for effecting such changes.)

Upon receipt of such a message, a remote peripheral can use the identifying information to determine whether the received information corresponds to a relevant movable barrier operator (i.e., to a movable barrier operator with which the remote peripheral has been previously associated). When information from an unrecognized movable barrier operator is received for whatever reason or due to whatever circumstance, the remote peripheral can choose to simply ignore the information and thereby avoid taking a potentially inappropriate action.

Returning again to FIG. 3, the process 30 then provides for automatic transmission 33 of the status condition message via the carrier/transmitter of choice and as otherwise is generally described above. It would of course be possible to transmit other signals and messages via the transmitter too, if desired. For example, specific control signals could also be transmitted (either as part of the above-described message or as a separate message) as an integral part of the overall control strategy of the movable barrier operator.

Figure 5:
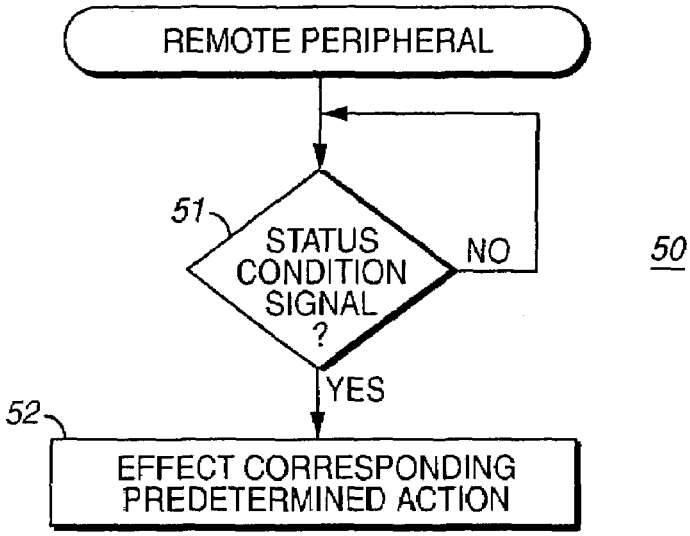
FIG. 5 comprises a flow diagram as configured in accordance with an embodiment of the invention.

In a similar fashion, and referring now to FIG. 5, the above-described remote peripheral 20 can serve as a suitable platform to effect a corresponding process 50 wherein the process 50 detects 51 for the reception of status condition signals and, upon receiving such a signal, uses the corresponding data to thereby permit effectuation 52 of a corresponding predetermined action. As already noted, the corresponding predetermined action (or actions) can be many and varied. A non-exhaustive illustrative listing could include:

activating a light (either ambient lighting and/or signaling indicia);
deactivating a light;
activating an audible alarm;
deactivating an audible alarm;
manipulating a locking mechanism;
providing a corresponding information display;
allowing remote modification of configuration variables; and
initiating a timing mechanism.

Other possibilities of course exist. It should also be clearly understood that functions not yet conceived or enabled may also be well served and supported by these embodiments, as these embodiments are not dependent upon the movable barrier operator having an already-existing native ability to support such functionality. Instead, by providing movable barrier operator status indicia, the remote peripherals are themselves able to intuit when circumstances are appropriate to initiate or restrain their own functionality and features.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. For example, if desired, the movable barrier operator could also wirelessly transmit control signaling in addition to the status condition information. Though such control signaling may not offer a same degree of long term flexibility as the preferred approaches set forth above, such control signaling may nevertheless serve to facilitate one or more presently known and highly desired features or functions.

Figure 6:
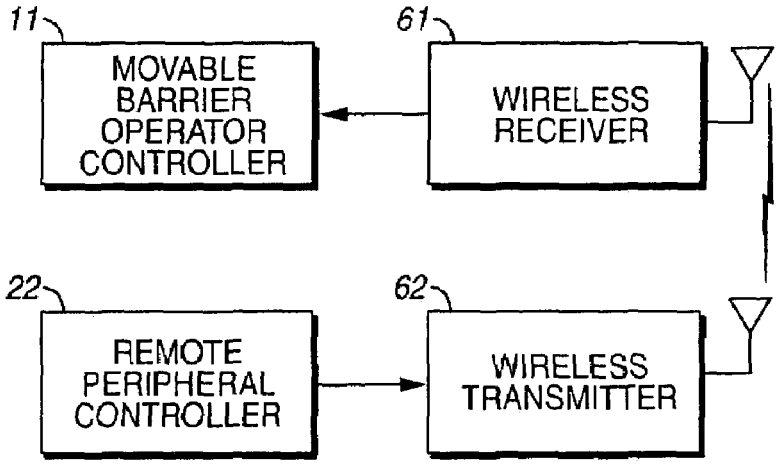
FIG. 6 comprises a block diagram as configured in accordance with an alternative embodiment of the invention.

As another example, and referring now to FIG. 6, a remote peripheral controller 22 can also couple to a wireless transmitter 62. In turn, the movable barrier operator controller 11 can further couple to a wireless receiver 61 that serves to compatibly receive messages as transmitted by the remote peripheral controller 11. This link can mirror the carrier/modulation/protocol mechanism described above for the movable barrier operator-to-remote peripheral link, or it can be different. As an illustrative example, the movable barrier operator can have a wireless status condition data transmitter that uses an infrared carrier and a receiver that uses a radio frequency carrier. So configured, a variety of useful purposes can be served. As one example, the remote peripheral controller 22 can query the movable barrier operator controller 11 via this communication mechanism to thereby cause the movable barrier operator controller 11 to respond with, for example, an updated status condition data message.

I claim:

1. A movable barrier operator comprising:
- a controller having a plurality of potential operational status conditions defined, at least in part, by a plurality of operating states;
- a movable barrier interface that is operably coupled to the controller;
- a wireless status condition data transmitter that is operably coupled to the controller, wherein the wireless status condition data transmitter transmits a status condition signal that:
  - corresponds to a present operational status condition defined, at least in part, by at least two operating states from the plurality of operating states; and
  - comprises an identifier that is at least relatively unique to the movable barrier operator, such that the status condition signal substantially uniquely identifies the movable barrier operator.

2. The movable barrier operator of claim 1 and further comprises at least one condition status sensor that is operably coupled to the controller.

3. The movable barrier operator of claim 2 wherein the wireless status condition data transmitter transmits data that corresponds to the at least one condition status sensor.

4. The movable barrier of claim 1 and further comprising a receiver that is operably coupled to the controller.

5. The movable barrier operator of claim 1 wherein the plurality of operating states includes at least one of:
- moving a movable barrier in a first direction;
- moving the movable barrier in a second direction;
- reversing movement of the movable barrier;
- halting movement of the movable barrier;
- detecting a likely presence of an obstacle to movement of the movable barrier;
- detecting a likely proximal presence of a human;
- receiving a wireless remote control signal;
- receiving a wireline remote control signal;
- receiving a learning mode initiation signal;
- a lighting status change;
- a vacation mode status change;
- detecting a likely proximal presence of a vehicle;
- detecting the identification of a proximal vehicle; and
- receiving an operating parameter alteration signal.

6. The movable barrier operator of claim 1 wherein the wireless status condition data transmitter comprises a radio frequency carrier-based transmitter.

7. The movable barrier operator of claim 1 wherein the wireless status condition data transmitter comprises an infrared carrier-based transmitter.

8. The movable barrier operator of claim 1 wherein the wireless status condition data transmitter comprises a sonic carrier-based transmitter.

9. The movable barrier operator of claim 1 wherein the controller includes transmitter control means for automatically causing the wireless status condition data transmitter to transmit a data signal.

10. The movable barrier operator of claim 9 wherein the transmitter control means automatically causes the wireless status condition data transmitter to transmit the status condition data signal in response to detecting at least a first predetermined condition.

11. The movable barrier operator of claim 10 wherein the first predetermined condition comprises at least one of the controller:

moving a movable barrier in a first direction;
moving the movable barrier in a second direction;
reversing movement of the movable barrier;
halting movement of the movable barrier;
detecting a likely presence of an obstacle to movement of the movable barrier;
detecting a likely proximal presence of a human;
receiving a wireless remote control signal;
receiving a wireline remote control signal;
receiving a learning mode initiation signal;
receiving an operating parameter alteration signal;
expiration of a predetermined duration of time; and
attainment of a predetermined point in time.

12. The movable barrier operator of claim 4 wherein the controller includes transmitter control means for automatically causing the wireless status condition data transmitter to transmit a status condition data signal in response to the receiver receiving at least a first predetermined signal.

13. The movable barrier operator of claim 12 wherein the wireless data transmitter comprises an infrared carrier-based transmitter and the receiver comprises a radio frequency carrier-based receiver.

14. A method comprising:
at a movable barrier operator:
detecting at least one predetermined condition as corresponds to a present operational status defined, at least in part, by at least two operating states, of the movable barrier operator;
in response to detecting the at least one predetermined condition, automatically wirelessly transmitting a status condition signal that:
represents the present operational status defined, at least in part, by the at least two operating states; and
comprises an identifier that is at least relatively unique to the movable barrier operator, such that the status condition signal substantially uniquely identifies the movable barrier operator.

15. The method of claim 14 wherein detecting at least one predetermined condition includes detecting at least one of:
moving a movable barrier in a first direction;
moving the movable barrier in a second direction;
reversing movement of the movable barrier;
halting movement of the movable barrier;
detecting a likely presence of an obstacle to movement of the movable barrier;
detecting a likely proximal presence of a human;
receiving a wireless remote control signal;
receiving a wireline remote control signal;
receiving a learning mode initiation signal;
a lighting status change;
a vacation mode status change;
detecting a likely proximal presence of a vehicle; and
receiving an operating parameter alteration signal.

16. The method of claim 14 wherein detecting at least one predetermined condition includes:
monitoring a plurality of operational status conditions;
detecting the at least one predetermined condition when any of the plurality of operational status conditions occurs.

17. The method of claim 14 wherein detecting at least one predetermined condition includes at least one of:
receiving sensor information from a sensor that senses the at least one predetermined condition; and
monitoring an operating state of the movable barrier operator.

18. The method of claim 14 wherein automatically wirelessly transmitting a status condition signal includes automatically wirelessly transmitting a status condition signal using at least one of:
a radio frequency carrier;
a sonic carrier; and
an optical carrier.

19. The method of claim 18 and further comprising also using a wireline connection to transmit at least a portion of the status condition signal.

20. The method of claim 14 wherein automatically wirelessly transmitting a status condition signal includes automatically wirelessly transmitting a status condition signal that includes an identifier that corresponds to the movable barrier operator.

21. The method of claim 14 and further comprising: at a remote peripheral apparatus:
receiving the status condition signal;
in response to receiving the status condition signal, effecting a predetermined action that corresponds to the status condition signal.

22. The method of claim 21 wherein the predetermined action includes at least one of:
activating a light;
deactivating a light;
activating an audible alarm;
deactivating an audible alarm;
manipulating a locking mechanism;
providing a corresponding information display;
allowing remote modification of configuration variables; and
initiating a timing mechanism.

23. The method of claim 14 wherein detecting at least one predetermined condition includes receiving a wireless signal that includes, at least in part, an inquiry signal.

24. An apparatus comprising:
a movable barrier operator having:
a controller having a plurality of potential operational status conditions defined, at least in part, by a plurality of operating states; and
a wireless status condition transmitter operably coupled to the controller, wherein the wireless status condition data transmitter transmits a status condition signal that:
corresponds to a present operational status condition defined, at least in part, by at least two operating states from the plurality of operating states; and
comprises an identifier that is at least relatively unique to the movable barrier operator, such that the status condition signal substantially uniquely identifies the movable barrier operator;
a remote peripheral having:
a wireless receiver that is communicatively compatible with the wireless transmitter;
a peripheral controller that is operably coupled to the wireless receiver.

25. The apparatus of claim 24 wherein the plurality of operating states includes at least one of:
moving a movable barrier in a first direction;
moving the movable barrier in a second direction;
reversing movement of the movable barrier;
halting movement of the movable barrier;
detecting a likely presence of an obstacle to movement of the movable barrier;
detecting a likely proximal presence of a human;
receiving a wireless remote control signal;
receiving a wireline remote control signal;
receiving a learning mode initiation signal;

a lighting status change;

a vacation mode status change;

detecting a likely proximal presence of a vehicle; and receiving an operating parameter alteration signal.

26. The apparatus of claim 24 wherein the remote peripheral comprises at least one of:

an informational display;

a light fixture;

a remote access interface;

a timer apparatus; and an alarm.

27. The apparatus of claim 24 wherein the movable barrier operator further includes a wireless receiver that is operably coupled to the controller.

28. The apparatus of claim 27 wherein the remote peripheral further includes a wireless transmitter that is communicatively compatible with the wireless receiver of the movable barrier operator and that is operably coupled to the peripheral controller.

29. The apparatus of claim 24 and further comprising a plurality of the remote peripherals.

30. The apparatus of claim 24 wherein the peripheral controller includes reception means for determining when a wireless signal as received from the movable barrier operator includes an identifier that corresponds to the movable barrier operator.

31. The apparatus of claim 30 wherein the reception means further provides a first control signal when the wireless signal does include the identifier and does not provide the first control signal when the wireless signal does not include the identifier.

* * * * *